US006847268B2

(12) United States Patent
Haunberger et al.

(10) Patent No.: US 6,847,268 B2
(45) Date of Patent: Jan. 25, 2005

(54) WIDE-BAND CIRCUIT FOR SPLITTING OR JOINING RADIO-FREQUENCY POWERS

(75) Inventors: Thomas Haunberger, Bad Reichenhall (DE); Franz Pichler, Raubling (DE); Manuel Lund, Prutting (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/181,474

(22) PCT Filed: Jan. 18, 2001

(86) PCT No.: PCT/EP01/00551

§ 371 (c)(1),
(2), (4) Date: Jul. 18, 2002

(87) PCT Pub. No.: WO01/54222

PCT Pub. Date: Jul. 26, 2001

(65) Prior Publication Data

US 2003/0003814 A1 Jan. 2, 2003

(30) Foreign Application Priority Data

Jan. 20, 2000 (DE) ..... 100 02 317
Sep. 28, 2000 (DE) ..... 200 16 787

(51) Int. Cl.[7] ..... H01P 5/12
(52) U.S. Cl. ..... 333/125; 333/132
(58) Field of Search ..... 333/124, 125, 333/100, 245, 132, 2, 32, 127, 128, 103, 164; 330/124 R, 276, 295; 343/744; 123/242

(56) References Cited

U.S. PATENT DOCUMENTS

| | | | | | |
|---|---|---|---|---|---|
| 2,605,356 | A | | 7/1952 | Ragan | |
| 2,605,357 | A | | 7/1952 | Ragan | |
| 2,657,362 | A | | 10/1953 | Epperson | |
| 2,667,619 | A | | 1/1954 | Raymond | |
| 3,324,421 | A | | 6/1967 | Fujimoto | |
| 3,492,501 | A | * | 1/1970 | Malone et al. | 333/100 |
| 3,974,465 | A | * | 8/1976 | White | 333/164 |
| 4,684,874 | A | * | 8/1987 | Swift et al. | 333/125 |
| 4,697,160 | A | * | 9/1987 | Clark | 333/103 |
| 5,410,281 | A | * | 4/1995 | Blum | 333/127 |
| 5,467,063 | A | | 11/1995 | Burns et al. | |
| 6,005,454 | A | * | 12/1999 | Kim | 333/128 |
| 6,054,906 | A | * | 4/2000 | Kim | 333/124 |
| 6,163,220 | A | * | 12/2000 | Schellenberg | 330/295 |
| 6,489,859 | B1 | * | 12/2002 | Tahara et al. | 333/124 |
| 6,518,856 | B1 | * | 2/2003 | Casale et al. | 333/124 |
| 6,586,999 | B2 | * | 7/2003 | Richley | 330/275 |
| 6,646,504 | B2 | * | 11/2003 | Dittmer et al. | 330/124 R |

FOREIGN PATENT DOCUMENTS

| | | |
|---|---|---|
| DE | 1 766 762 | 3/1972 |
| DE | 39 25 316 | 1/1990 |
| EP | 0 496 999 | 8/1992 |
| EP | 0 518 310 | 8/1995 |

OTHER PUBLICATIONS

"Kathrein–Werke KG; Base Station Antennas for Mobile Communications", Drukvermerk: Mar. 1999, pp. 159–167.

* cited by examiner

*Primary Examiner*—Patrick Wambley
(74) *Attorney, Agent, or Firm*—Nixon & Vanderhye P.C.

(57) ABSTRACT

An improved circuit for splitting or for joining radio-frequency powers, having a main line (7) which is connected between an input port (1) and a first output port (3), and having a branch line (11) which branches off from the main line at a branching point (9) and leads to a second output port (5), is distinguished in that a compensating element (61) is provided which, in particular, is adjustable or can be fitted and removed differently, and which can be varied, varying the capacitance of at least one capacitor ($C_1$, $C_2$, $C_3$) which is connected in the branch line (11), and/or varying the electrical length of a spur line (37) which is coupled to the branch line (11), such that the change in the magnitude of the power which is tapped off also makes it possible to compensate at the same time for the resistance change which is caused by the change in the power split.

27 Claims, 9 Drawing Sheets

WIDE-BAND CIRCUIT FOR SPLITTING OR JOINING RADIO-FREQUENCY POWERS

CROSS-REFERENCES TO RELATED APPLICATIONS

This application is the US national phase of International Application No. PCT/EP01/00551 filed on 18 Jan. 2001, which designated the U.S. PCT/EP01/00551 claims priority to DE Application No. 100 02 317.7 filed 20 Jan. 2000 and DE Application No. 200 16 787.1 filed 28 Sep. 2000. The entire contents of these applications are incorporated herein by reference.

FIELD

The technology described herein relates to a circuit for splitting or joining radio-frequency power.

BACKGROUND AND SUMMARY

Circuits for splitting or joining radio-frequency power are known, for example, as so-called bridge circuits or as Wilkinson couplers and are used in particular for connecting radio-frequency transmitters or antennas in parallel, in radio-frequency technology.

A circuit of this generic type for splitting and joining radio-frequency powers has been disclosed, for example, in the prospectus Kathrein-Werke KG "Base Station Antennas for Mobile Communication, catalog 03.99".

The circuit is arranged, for example, in an elongated housing. At one of the end faces the so-called sum port (input) can be provided. On the opposite end, for example, a first individual port can be provided. A second individual port can be provided on a transverse face, adjacent to this end face, but at right angles to it.

The power is split by means of different resistances at the individual port (different individual port resistances connected in parallel). The first individual port in this case remains unchanged (i.e., is not transformed). The second individual port is subjected, for example, to $\lambda/4$ transformation. In other words, the power split according to the prior art is provided by means of a different impedance Z ("$\lambda/4$ transformation"). The power division in this case produces a reaction on the input, however. In particular, if the division ratios differ, they cannot be set such that they are variable, so that different types and appliances must be provided for the different power division ratios.

Another circuit for splitting or joining radio-frequency power is known from U.S. Pat. No. 3,324,421. There, a main line is connected between an input port and first output port, and a branch line branches off from the main line at a branching point. An adjustable output element is provided in this circuit, which determines the magnitude of the power tapped off by varying the capacitance of a capacitor which is connected in the branch line. Depending on the measurement frequency, the output element can in this way be adapted over a narrow bandwidth, but only the measurement branch is adapted. This output element causes reactions on the impedance of the main line, however, especially at relatively high frequencies, It is known from U.S. Pat. No. 2,657,362 for, for example, to match the impedance of an antenna to a different impedance by means of a mechanically varied combination of inductances and capacitances.

A circuit of this generic type for power splitting has also been disclosed, for example, in U.S. Pat. No. 2,667,619. This circuit comprises a main line which is connected between an input port and a first output port, and a branch line which branches off from the main line at a branching point and leads to a second output door. Furthermore, a spur line is provided, which is coupled to the branch line. According to this prior publication, serial capacitances with an electrically effective length of $\lambda/4$ or $\lambda/2$ based on the operating frequency are provided in the outputs. A movable trimming element is provided, which, via an operating element, can at the same time be moved into the main path and the branching path, engaging in its longitudinal direction. This means that the function of the distributor is provided by the simultaneous increase and decrease in the series capacitances. Since the series capacitances are a function of the wavelength, the distributor is suitable, by virtue of its design, only for channel-selective or narrow-band applications. It is not possible to use this prior publication to produce a power distributor for wide bandwidths from, for example, 800 to 2200 MHz.

In this design according to the abovementioned arrangement, it is furthermore provided for one output to be interrupted by a series capacitance. Furthermore, the trimming element and the spur line are conductively connected to the inner conductors of the main line and branch line.

A largely similar circuit is also disclosed in U.S. Pat. No. 2,605,357. In contrast to the publication U.S. Pat. No. 2,667,619 mentioned above, the series capacitance is not varied by longitudinal movement of the inner conductors, but by twisting the coupling surfaces. In this case as well, the lengths of the coupling points are predetermined by the operating frequency. Thus, in this case as well, broadband use over a multiple of the wavelength is not feasible.

Thus, against the background of the generic prior art, it would be desirable to provide an improved circuit for power splitting, and in particular, an improved variable circuit for splitting or joining radio-frequency powers.

The circuit arrangement according to an exemplary non-limiting implementation is not only novel but, in terms of its overall structure and with regard to the advantages which can be achieved by it, is highly surprising. This is because one preferred embodiment of the circuit arrangement makes it possible to achieve a variable power split without the input impedance varying in the process. According to an exemplary non-limiting implementation, this is achieved by a combination of variable coupling capacitances and a variable spur line, in which case both elements can be varied in a preferred manner by means of a common control element.

The power split is in this case preferably implemented such that a further line, which is capacitively coupled, branches off from a continuous RF line at a defined point. In this case, a transformation is carried out for the resistance matching at the input port or sum port, without this having—as mentioned—any consequential effect on, or causing any change to, the input impedance. Frequency compensation or frequency predistortion is carried out on the output branch. According to an exemplary non-limiting implementation, the power split can now be varied by moving, without any problems, an adjustment or movement element which is provided, to be precise without any reaction on the input impedance. Now, according to an exemplary non-limiting implementation, not only different type appliances but only one type, which is adjustable differently, can be used for different power division ratios.

The circuit arrangement according to an exemplary non-limiting implementation can thus be installed for the most different forms of power branches in an RF broadband network, for example in the case of signal transmission in a building, for the various power branches in the individual stories, building complexes, etc. In this case, the desired power split can be set without any problems just by rotating an adjustment element such that it corresponds to the power branch to be provided.

Furthermore, a large number of distribution panels are normally required for the wiring in a building, in order to split the signals that are fed in (for example in the cellar) between a large number of lines. Sometimes it may be desirable to carry out a power split between different branch lines, possibly all having different proportions of the power, in the individual stories of a building. The advantages according to technology disclosed herein become even clearer. This is because, according to an exemplary non-limiting implementation, only a single circuit device is needed for, in particular, continuously variable power splitting, which can in each case be set without any problems for the particular requirements. This makes it possible, without any problems, to compensate for different cable lengths, cable attenuations, etc.

The power split according to an exemplary non-limiting implementation is preferably carried out using a compensating element which is arranged in a variable position. Varying the position varies the output of power into the branching line and, in the process according to an exemplary non-limiting implementation, at the same time compensates for the resistance change caused by the output variation. The compensating element, whose position can be varied mechanically, may be electrically conductive, but need not be. For example, it is just as possible to use a dielectric compensating element.

In one particularly preferred embodiment of an exemplary non-limiting implementation, the adjustment element may in this case be arranged in an axial extension for the branching line, with the main line, which runs between the input port and the further output port (that is to say between the sum port and the further individual port) being arranged transversely with respect to it.

The desired varied output can preferably be achieved by means of a mechanically adjustable probe, whose axial position can be varied, for example, by radial twisting.

However, by way of example, the compensating element may also be adjusted differently by means of some other type of adjustment mechanism. For this purpose, a further preferred exemplary embodiment provides for the control element to have the capability to be moved linearly on the circuit housing. The adjustment movement is in this case preferably carried out in the axial longitudinal direction of the circuit housing. The adjustment movement (preferably the linear adjustment movement of the compensating element) can be produced and implemented via this adjustment movement. Preferably this is internally in the adjustment element, with the adjustment movement of the compensating element being at right angles to the adjustment movement of the control element. The overall exemplary non-limiting arrangement has the further advantage that, for example, an easily visible scale can be fitted, in which case it is possible to read the current power split setting exactly, as a function of the movement position of the adjustment element.

Finally, the step-up ratio between the control element and the compensating element may also be produced non-linearly, if this is desired. Otherwise, a linear step-up ratio can be achieved at any time.

The bandwidth of the output unit may be very wide, for example 45%.

The circuit arrangement according to an exemplary non-limiting implementation may be designed to be coaxial. However, it may also be implemented by means of discrete components, or using board technology.

It should be noted, merely for the sake of completeness, that the circuit according to an exemplary non-limiting implementation may also have a number of variable output elements in order to form an n-tuple distribution panel.

In more detail, the circuit according to an exemplary non-limiting implementation for splitting or for joining radio-frequency powers, has a main line or main path (7) which is connected between an input port (1) and a first output port (3), and has a branch line (11) which branches off from the main line at a branching point (9) and leads to a second output port (5). It is preferably distinguished in that a compensating element (61) is provided which is, in particular, adjustable, or can be installed and removed differently. The compensating element can be varied by varying the capacitance of at least one capacitor ($C_2$, $C_3$), which is connected in the branch line (11), and/or by varying the electrical length of a spur line (37) which is coupled to the branch line (11), such that the variable magnitude of the power being tapped off at the same time also makes it possible to compensate for the resistance change caused by the change in the power split.

BRIEF DESCRIPTION OF THE DRAWINGS

These and other exemplary illustrative non-limiting features and advantages will be better and more completely understood by referring to the following detailed description in conjunction with the drawings, of which.

DETAILED DESCRIPTION OF EXAMPLE NON-LIMITING ILLUSTRATIVE IMPLEMENTATIONS

Figure 1:
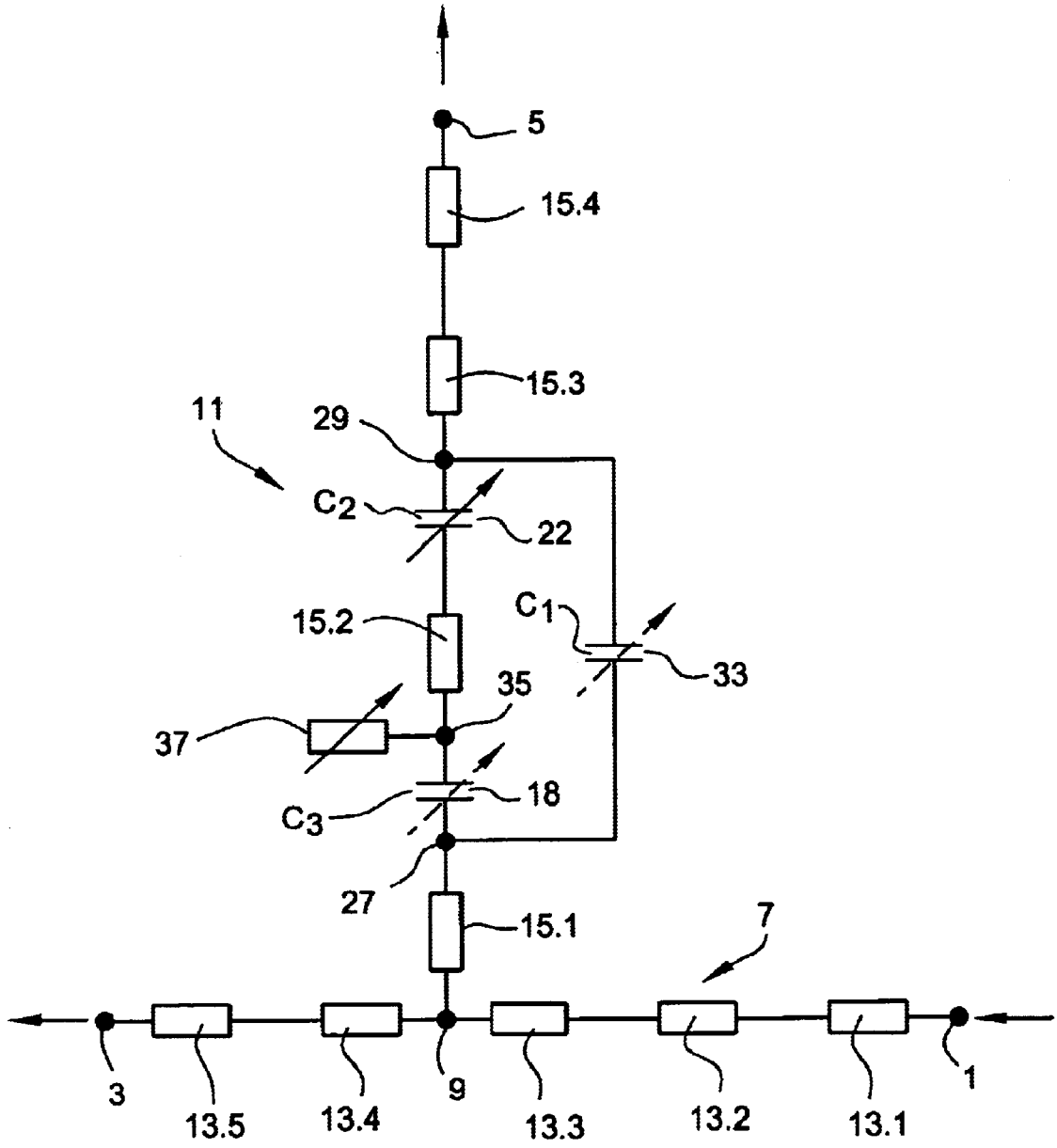
FIG. 1 shows an equivalent circuit according to an exemplary non-limiting implementation with discrete elements, in order to explain the methods of operation of the design of an exemplary circuit implementation for splitting or joining radio-frequency powers.

FIG. 1 shows an equivalent circuit of an exemplary non-limiting variable, broadband power splitting circuit.

The circuit in this case comprises a first input or sum port 1 and a first output or individual port 3, as well as a second output or individual port 5.

As a rule, the so-called main line 7 (main path) is provided between the input port and the first output port 3, and a branch line 11 branches off from it at a branching point 9. A power which is less than 50% of the total power fed in at the input 1 is normally tapped off at the second output port 5.

The system impedance between the input port 1 and the branching point 9 in the main line 7 is 50Ω in this specific non-limiting example.

In principle, the main line 7 comprises one or more series-connected RF lines 13, that is to say RF line sections 13.1, 13.2, . . . to 13.5 in the illustrated exemplary embodiment. The branch line 11 likewise comprises a coaxial line with a first RF line section 15.1, a capacitor 18 which is also denoted by the identification $C_3$, a downstream further RF line section 15.2, a further capacitor 22 which is also identified as the capacitor $C_2$, and further downstream RF line sections 15.3, 15.4, etc.

A first coupling point 27 is provided between the first RF line section 15.1 and the first capacitor 18, and a second coupling point 29 is provided between the further capacitor 22 and the downstream RF line section 15.3, between which a capacitor 33, which is also sometimes identified as the capacitor C, in the following text, is connected in a parallel branch 31.

An open spur line 37 is provided between the capacitor 18 and the RF line section 15.2, at the branching point 35 provided there.

The capacitors 18, 22 which have been mentioned and the electrically effective length of the spur line 37 are each in the form of adjustable, variable components. The capacitor connected in the parallel branch 31 may also be in the form of a variable capacitor, but need not be.

A common adjustment logic device or mechanism which may be provided makes it possible to ensure that, by jointly adjusting the variable capacitors and varying the length of the spur line 37, the RF power which is tapped off at the second output 5 can be set and adjusted variably and continuously, with the power which is produced at the first output 3 being reduced appropriately, corresponding to the proportion of the power which is tapped off. The adjustment process is in this case carried out without any effect on or change to the input impedance of the input 1. Furthermore, appropriate resistance predistortion is carried out, in order in this way to achieve the desired resistance compensation, overall.

Figure 2:
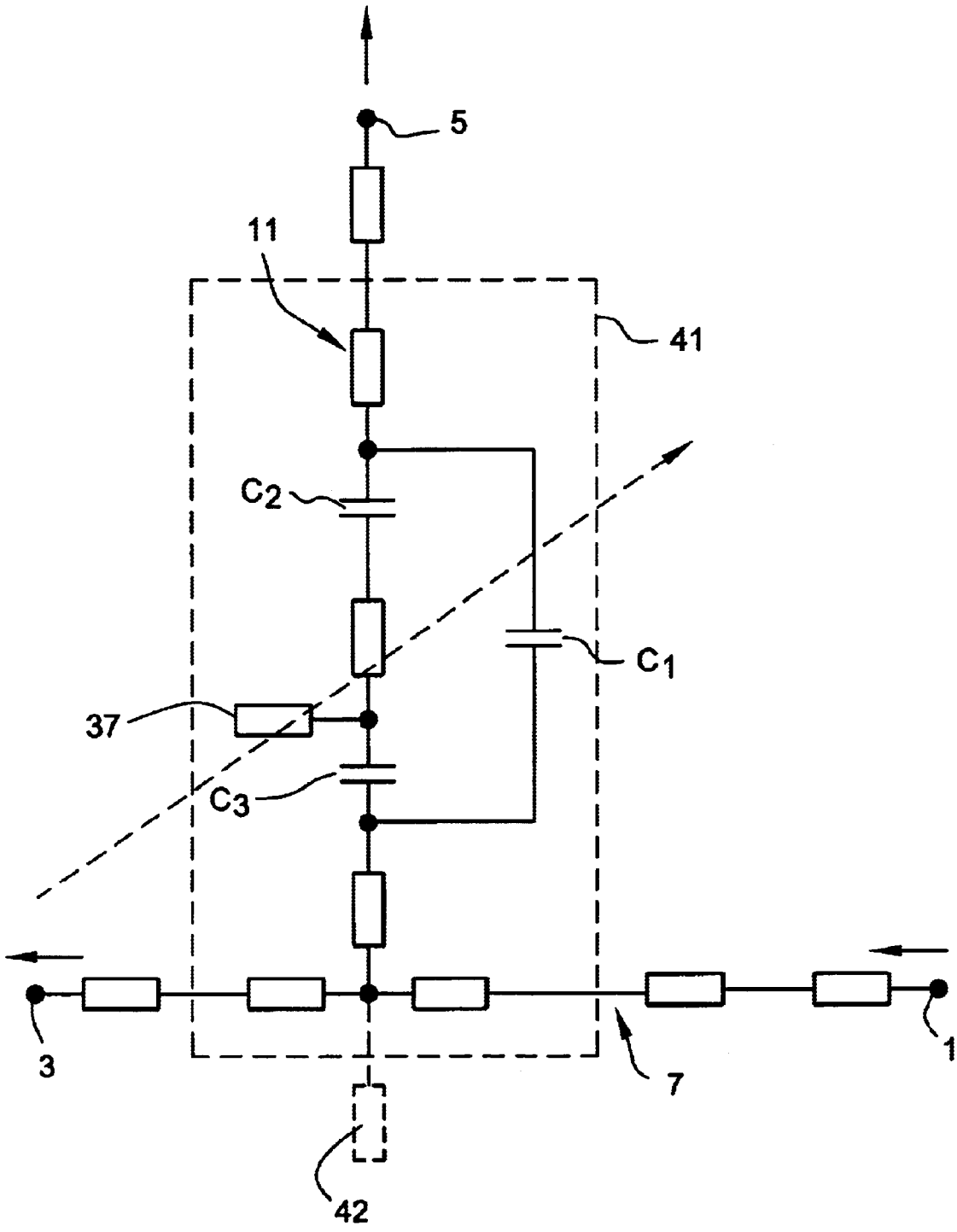
FIG. 2 shows an exemplary embodiment, which essentially corresponds to FIG. 1, and which is suitable for variable, broadband power splitting, in which a common control element is provided in order to produce the different power split.

FIG. 2 shows a further equivalent circuit for the embodiment shown in FIG. 1, for variable, broadband power splitting. In this case, the unit 41 is represented by dashed lines and, by means of a common control element (symbolized by the common arrow crossing the unit 41) makes it possible to set a different power split.

The dots at the junction point 9 in FIG. 2 likewise show that an additional spur line 42 for resistance matching may also be provided, if desired, here.

Figure 3:
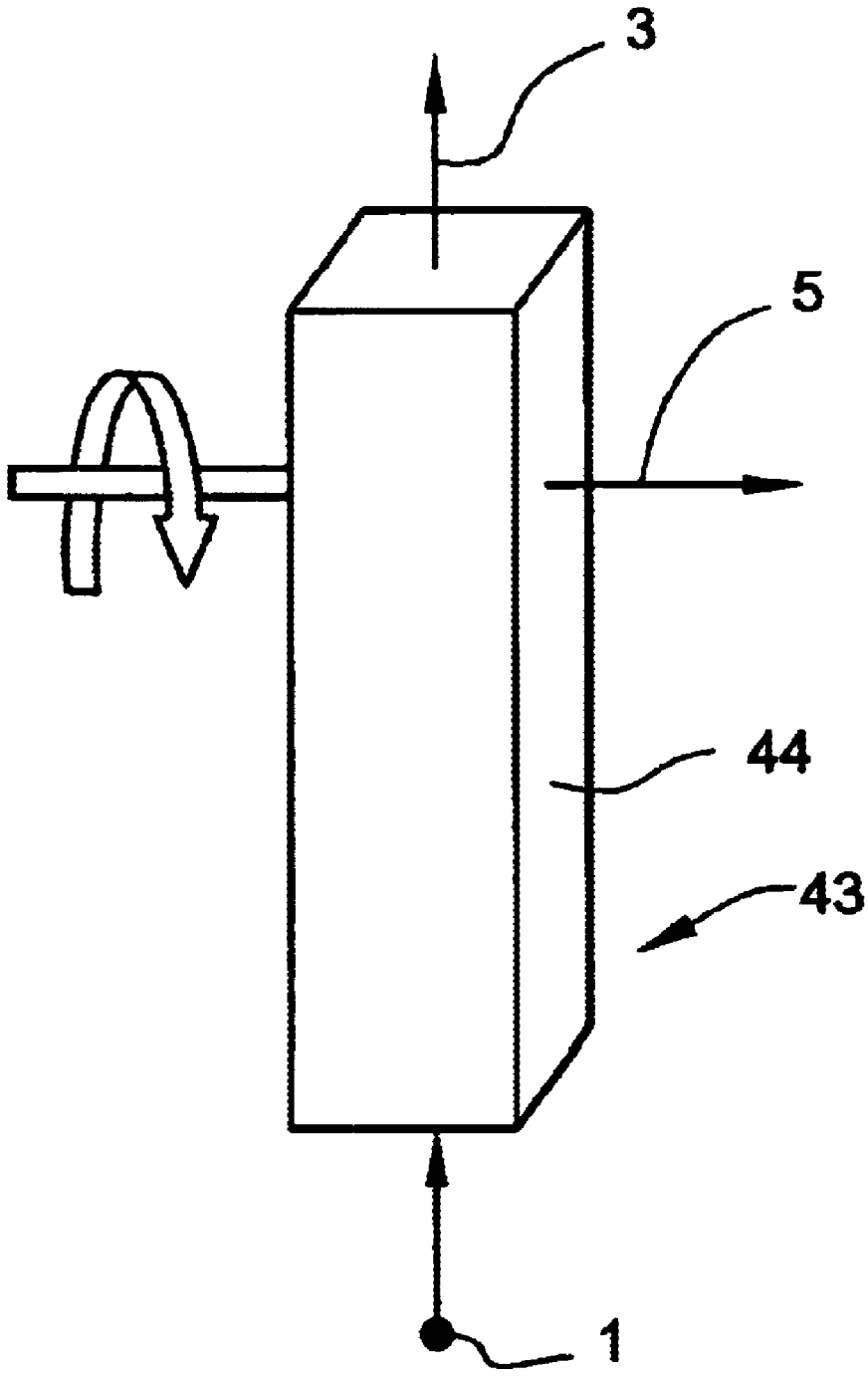
FIG. 3 shows a schematic illustration in order to explain one specific exemplary embodiment relating to a coaxial circuit design.

The schematic design of an exemplary embodiment, which will be explained in greater detail in the following text with reference to FIGS. 4 and 5, of a circuit according to an exemplary non-limiting embodiment and using a coaxial design will be explained with reference to FIG. 3.

The housing 43 of the circuit arrangement in this case comprises, for example, a quadrilateral tube with a hollow cylindrical interior as the outer conductor 13", through which an inner conductor 13', in the form of a rod, is passed. A corresponding coaxial socket can thus be arranged at both the input port 1 and at the first output port 3, on the opposite end faces, whose inner conductors are connected to the inner conductor 13', and whose outer conductors are connected to the outer conductor 13", of the circuit arrangement.

Figures 4, 5:
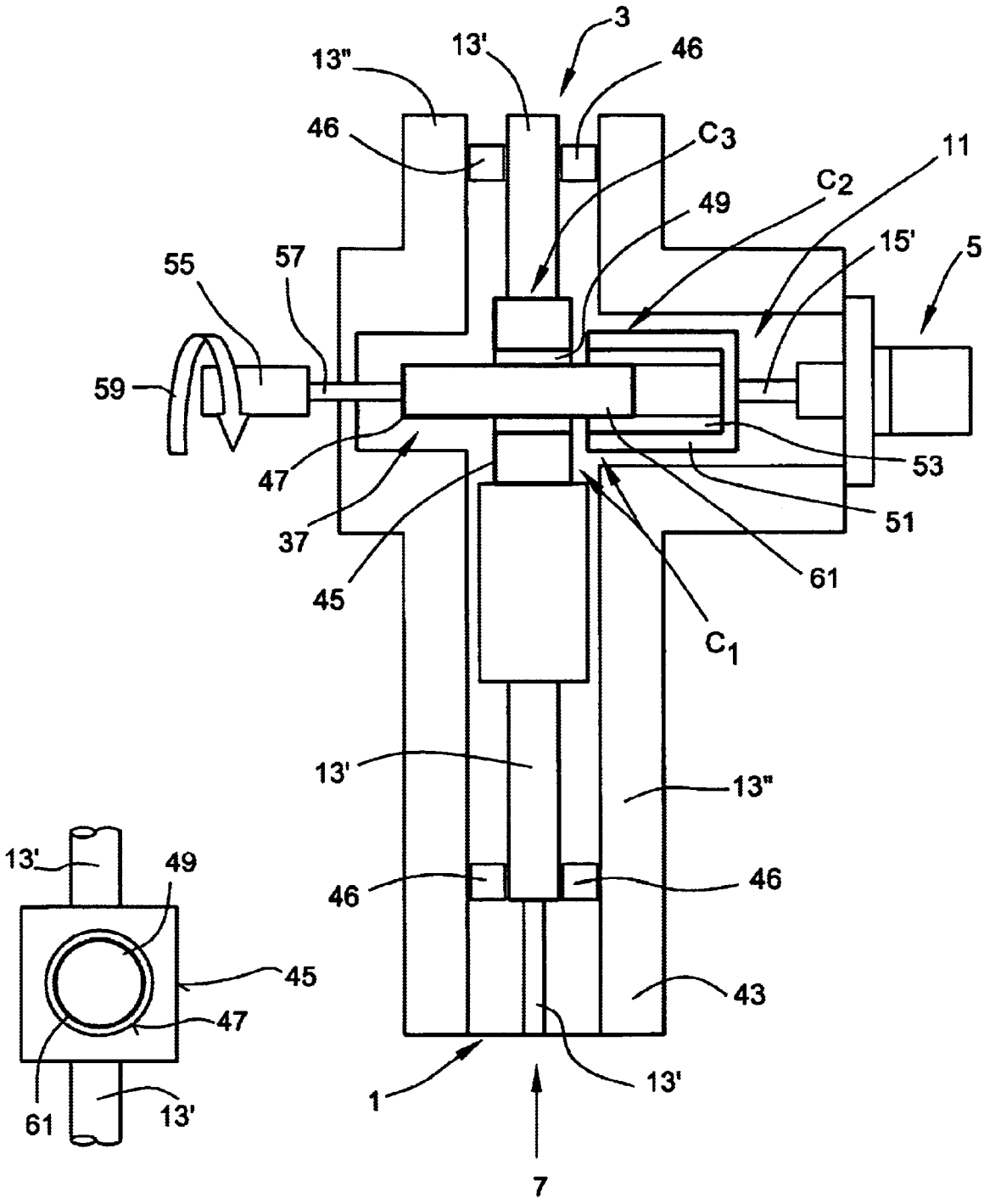
FIG. 4 shows a schematic section illustration through an exemplary embodiment according to an exemplary non-limiting embodiment, with a corresponding basic illustration as in FIG. 3.
FIG. 5 shows an illustration of a detail of a cross section through the thickened inner conductor section in FIG. 4, with the transverse hole incorporated therein.

The second output port 5 is provided in the vicinity of the first output port 3 on the side 44 adjacent to the opposite end face, and may likewise once again be in the form of an RF connection with an appropriate RF socket, as is also shown in greater detail in the schematic cross-sectional view in FIG. 4.

It can be seen from the schematic cross-sectional view in FIG. 4 that the main line 7 comprises the coaxial tube 43 which has been mentioned, with the outer conductor 13" forming the housing 43 of the circuit arrangement, and, in the interior, the inner conductor 13', which is DC-isolated from it, being passed through it as a metallically conductive rod. To this end the electrically conductive metallic rod which is used as the inner conductor 13' is mounted and held at least in the region of the input port 1 and of the first output port 3 at the end of the main line 7 in corresponding insulating supports 46, which are preferably composed of plastic, and is thus DC-isolated from the housing.

At the level of the second output port 5, the electrically continuous inner conductor or rod 13' of the main line 7 has a thickened section 45 with a transverse hole 47, within which, in the illustrated exemplary embodiment, an insulator 49 is incorporated, which is in the form of a sleeve and is preferably composed of plastic. As can be seen from the detail cross-sectional illustration (rotated through 90°) in FIG. 5, this means that there is no interruption in the conductivity of the inner conductor 13'.

The inner conductor 15', which is in the form of a rod, on the coaxial connecting line or of the coaxial connection for the second output port 5 is provided such that it is axially aligned with the transverse hole 47 and has, adjacent to the transverse hole 47 in the inner conductor 13' of the main line 7, an end section 51 which is in the form of a sleeve or pot and which, in the illustrated exemplary embodiment, is likewise once again provided on the inside with a hollow cylindrical insulator 53, preferably composed of plastic.

Axially opposite on the other side of the outer conductor or housing 43, there is a control element 55, illustrated with a spindle 57 in the illustrated exemplary embodiment, in order to push a compensating element 61 increasingly further in or back in the axial direction by twisting as shown by the illustrated arrow 59. The control element 55 with the spindle 57 are in this case not electrically conductively coupled, at least not to the outer conductor 13". The compensating element 61, which is metallic in the illustrated exemplary embodiment, is thus moved axially differently via the spindle 57, with the compensating element 61 in this case penetrating to a different extent into the section 45, which is thickened in the form of a hollow cylinder, of the inner conductor 13' of the main line 7, and also engaging to a different extent in the hollow-cylindrical inner conductor 15', depending on the adjustment of the spindle, and with the inner conductor 15' being DC-isolated from the inner conductor 13' of the main line.

The capacitor $C_3$ (18) which has been mentioned is formed by the hollow cylinder or body 45 (which is in the form of a sleeve) which is part of the inner conductor 13' of the main line 7, and by the cylindrical compensating element 61 which passes through this body 45 that is in the form of a sleeve. Since the compensating element also engages to a different extent in the further body 51, which is in the form of a sleeve or socket, and is aligned with the body 45 that is in the form of a sleeve, the further capacitor $C_2$ (22) is formed between the compensating element 61 and this body 51 that is in the form of a sleeve.

Finally, the capacitor $C_1$ (33), which has likewise already been mentioned, is formed by the two bodies 45 (which is electrically conductively connected to the inner conductor 13' of the main line 7), which are in the form of sleeves and are DC-isolated from one another, and to the body 51 (which is electrically connected to the inner conductor 15' of the branch line 11), which is in the form of a sleeve and is axially at a distance from the former.

As mentioned, the compensating element can be adjusted axially by twisting the adjustment element, thus varying the capacitor $C_3$ (depending on the extent to which the compensating element 61 enters the body 45 which is in the form of a sleeve, or passes through it) and, in particular, $C_2$ (depending on the extent to which the compensating element 61 enters the body 51, which is in the form of a sleeve or socket). Since the axial distance between the two bodies 45, 51 which are in the form of sleeves does not vary, the capacitor $C_1$ which is formed between these components is not variable in this embodiment. The electrically effective layer of the open spur line 37 is also varied as appropriate in this case by turning the compensating element in and out differently as appropriate, with the electrical length of the spur line 37 becoming shorter the further the compensating element 61 engages in or penetrates the corresponding bodies 45 or 51, which are in the form of sleeves, of the spur line.

Instead of the electrically conductive compensating element 61, a non-conductive compensating element 61 may also be used, which furthermore offers the advantage that it is then always possible to dispense with the insulators which have been mentioned in the interior of the adjustment elements 45, 51, which are in the form of sleeves or pots.

A power splitter, which is explained in a corresponding manner, has a broadband design and can be adjusted variably as required can be used without any problems in a broadband RF range from, for example, 800 MHz to 2200 MHz. The difference in the power split $_C$P between the output port 3 and 5 may in this case amount to values from 5 dB to 20 dB.

The exemplary embodiment has been explained with reference to an open spur line 37. However, a closed spur line 37 is also possible, at least in certain situations.

A more specific exemplary embodiment will now be described with reference to FIGS. 6 to 10, which differs from the previous exemplary embodiments primarily in that the control element 55 is not in the form of a control element 55' which can rotate.

Figure 6:
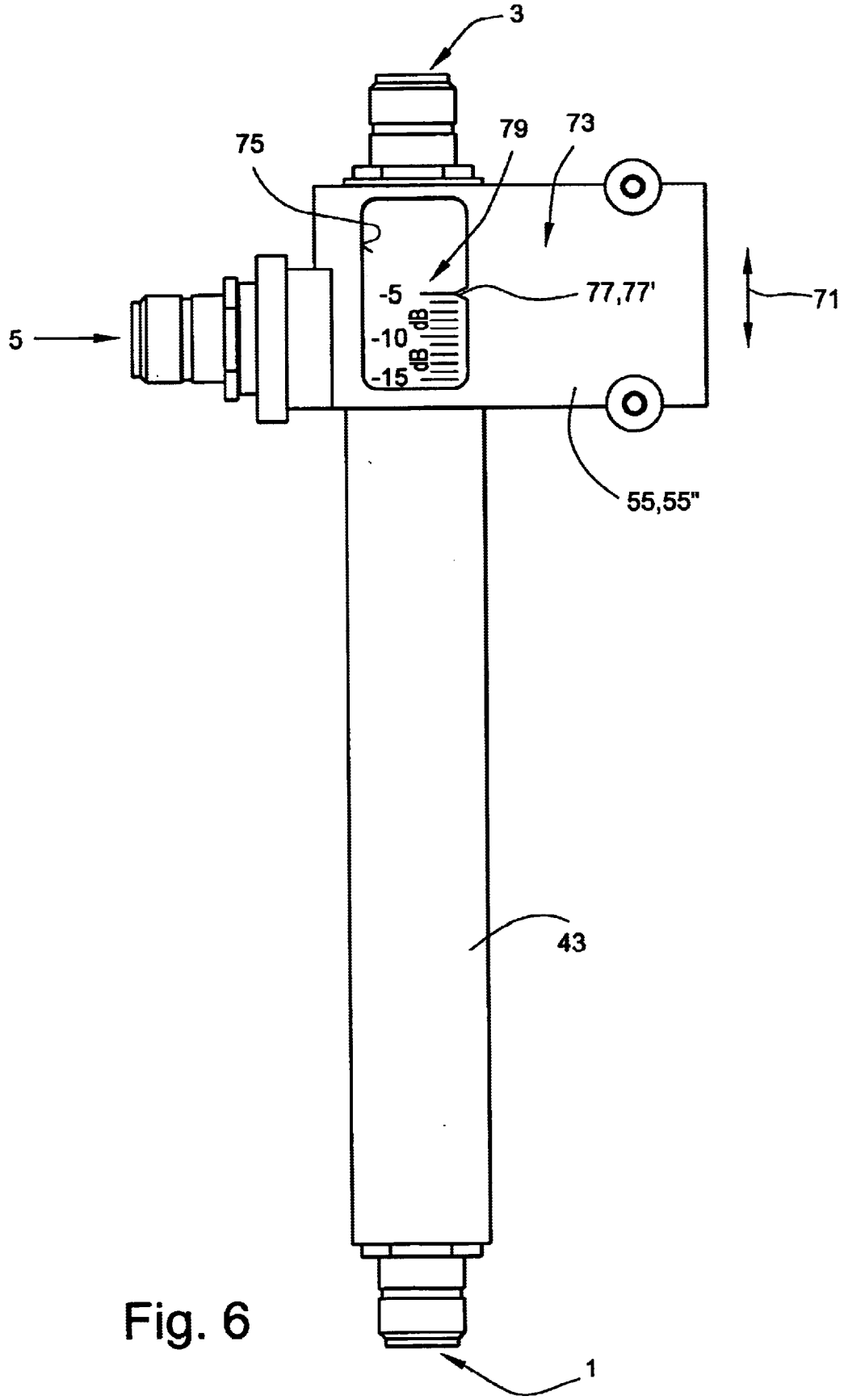
FIG. 6 shows a schematic side view of the appliance according to an exemplary non-limiting embodiment for power splitting, with the control element in a first adjustment position.
Figure 7:
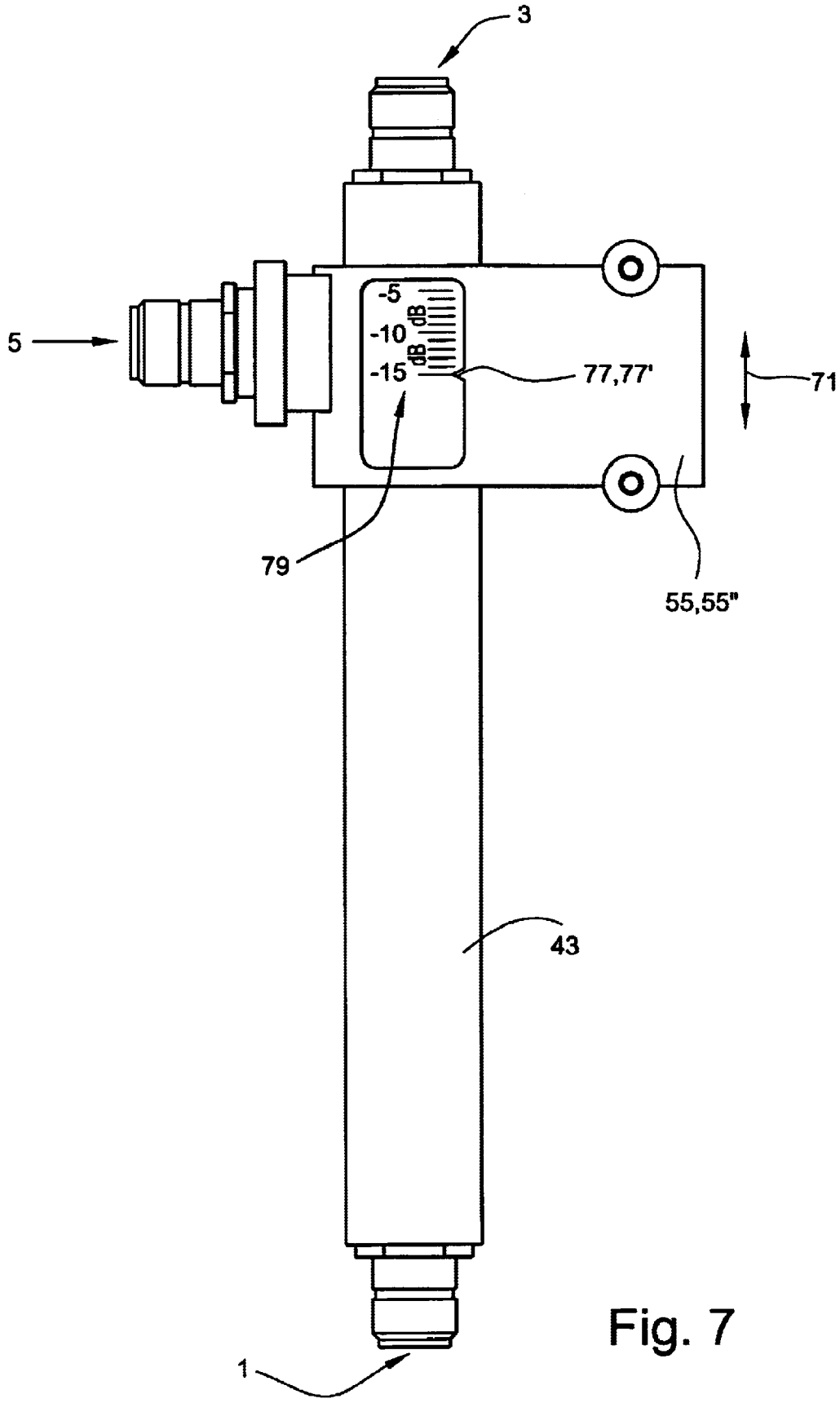
FIG. 7 shows a side view corresponding to FIG. 6, in which the control element is located in a different position to that shown in FIG. 6, in order to achieve a different power split.

A corresponding appliance according to an exemplary non-limiting embodiment for power splitting is shown in the form of a side view in FIG. 6, with the housing 43, which has a square cross section and extends in the axial longitudinal direction between the input port 1 and the input and output port 3.

At the level of the second output port 5, which is aligned transversely with respect to it, the linearly adjustable control element 55 is shown, which is cuboid in shape and in this case engages around the housing 43, which extends axially. This cuboid control element 55" can be moved along the illustrated arrow 71 in the longitudinal direction of the housing 43, and is in this case shown in its one end position in FIG. 6, and in FIG. 7 in its other extreme or end position, which is opposite the other end position.

The cuboid control element housing 55" in this case has on its one control element face 73 a recess which is, for example, rectangular, or a corresponding viewing area, with this recess or this viewing area 75 having an associated adjustment or reading device 77, in the illustrated exemplary embodiment in the form of a projecting tab 77'. Underneath the viewing area 75, that is to say the recess 75, a scale 79 is fitted externally on that housing wall 43' of the housing 43 which is located underneath. Depending on the axial adjustment movement of the control element 55', it is now possible to read exactly on the scale 79 how the power distribution is being implemented on the basis of the setting of the control element 75', at the two recesses 3 and 5.

Figure 8:
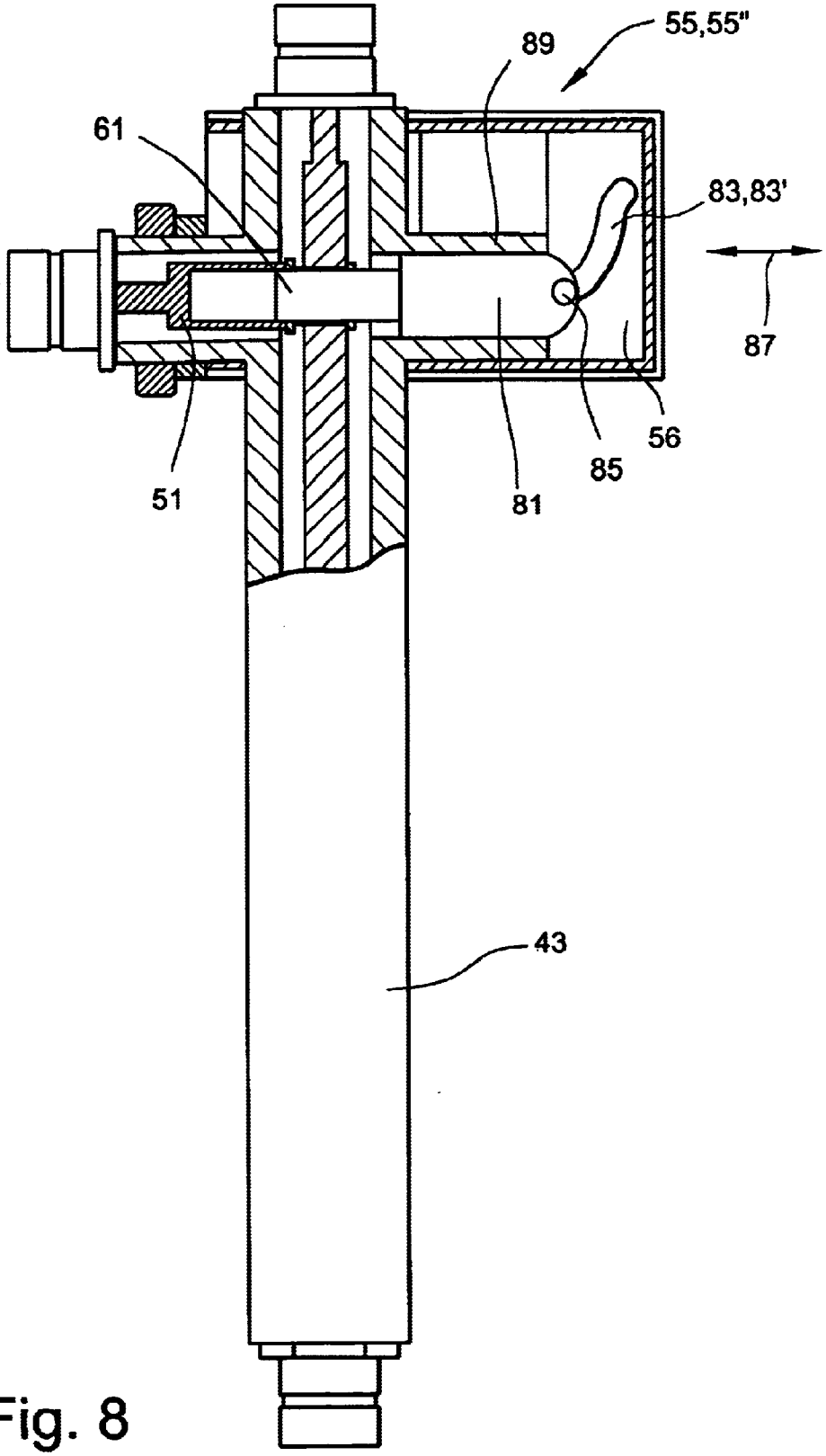
FIG. 8 shows a side view, corresponding to that in FIG. 6, of the appliance according to an exemplary non-limiting embodiment, partially in the form of a longitudinal section.
Figure 9:
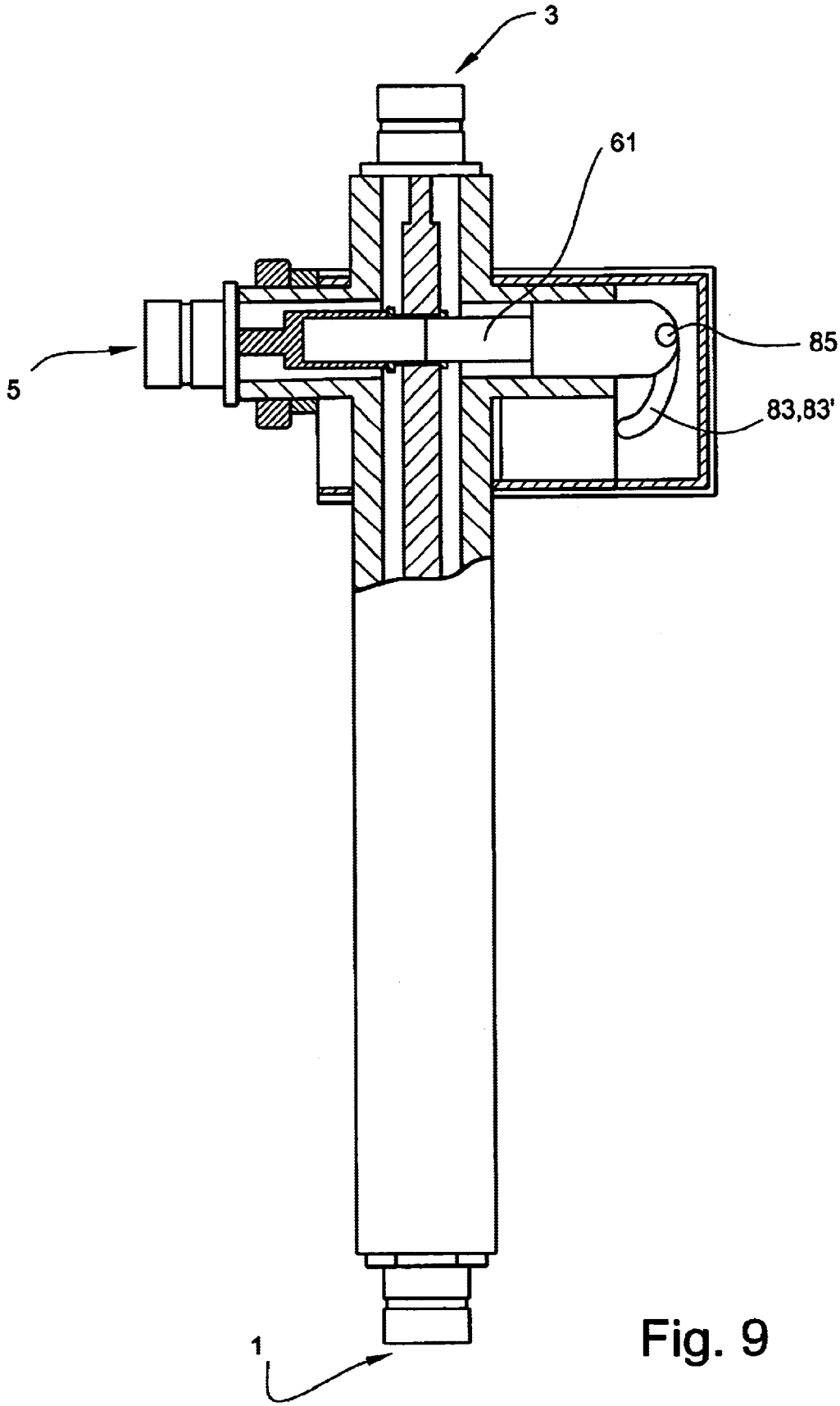
FIG. 9 shows a side view, corresponding to FIG. 7, of the appliance according to an exemplary non-limiting embodiment for power splitting, corresponding to the second switch position shown in FIG. 7, but shown partially in the form of a longitudinal section.
Figure 10:
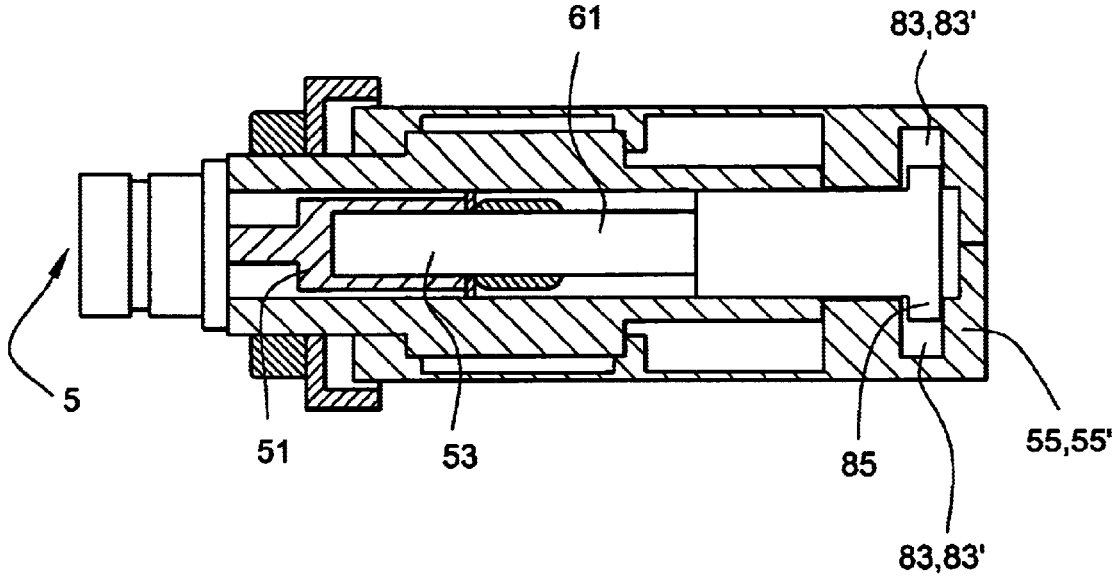
FIG. 10 shows a horizontal cross-sectional view, at right angles to the section views shown in FIGS. 8 and 9, in the switch position shown in FIG. 6 and 8.

FIGS. 8 to 10 show the control mechanism, showing the corresponding appliance, partially in section.

It can be seen from the section illustrations in FIGS. 8 and 9 that an insulator 53, which is in the form of a sleeve, is accommodated in the sleeve or in the end section 51, which is in the form of a pot, along which insulator 53 the compensating element 61 can be moved axially, transversely with respect to the axial direction of the housing 53—as discussed with reference to the previous exemplary embodiments. The axial adjustment movement of the compensating element 61 is produced via a transmission element 81 which is in the form of a connecting stub in the illustrated exemplary embodiment, is axially firmly connected to the compensating element 61 and can be moved together with this compensating element 61 with respect to the end section 51, which is in the form of a sleeve or pot.

As can be seen from the illustration in FIGS. 8 and 9, a slotted guide 83 in the form of a guide groove 83' is incorporated internally on a front and rear side wall section 56 in the control element 55", which can be moved in the direction of the arrow 71, in which guide groove 83' a guide pin 85 engages, which projects transversely with respect to the guide groove 83' and is formed on or is attached to the transmission element 81.

An adjustment movement of the cuboid control element 55' in the axial direction 71, that is to say in the axial longitudinal direction of the housing 43, necessarily results in an adjustment movement at right angles to this, namely in the adjustment direction 87. This is because the guide pin 85, which is held via the transmission element 81, cannot cope with an axial longitudinal movement direction corresponding to the illustrated arrow 71 and is held by the corresponding adjustment movement of the control element 55 such that it follows the respective position of the guide groove 83', as a result of which the transmission element 81, and hence also the compensating element 61, necessarily carries out the desired adjustment movement in the direction of the illustrated arrow 87. The transmission element 81 is thus guided in a sleeve 89.

In contrast to the illustrated exemplary embodiment, the slotted guide 83 or the guide groove 83' may be designed to be linear. This results in a linear step-up ratio. The step-up ratio depends on the groove gradient and may, for example, be in the order of magnitude of approximately 1:2. The slotted guide or the guide groove may, however, also be designed to be curved, as is shown in the exemplary embodiment in FIGS. 8 and 9, as a result of which a corresponding axial adjustment movement in the direction of the arrow 71 is changed to an entry movement or backward movement, of a different extent, of the compensating element 61 in the hollow or in the pot-shaped end section 51.

Said scale 79 may then be designed to match the step-up ratio and the capacitor effect in order in this way to clearly read what the power split setting is.

What is claimed is:

1. A wideband circuit for splitting or joining radio-frequency powers, comprising:

a main path connected between an input port and a first output port, the main path having an associated inner conductor;

a branch line which branches off from the main path at a branching point and leads to a second output port, an inner conductor leading to the branch line second output port;

a spur line coupled to the branch line, and a compensating element for splitting or joining radio-frequency powers together in different ways, the spur line being connected via a first capacitor to the inner conductor associated with the main path, and via a second capacitor to the inner conductor, which leads to the second output port, of the branch line, the capacitances of the first and second capacitors being variable, by means of the compensating element, which is adjustable or can be preselected differently, and/or can be installed or removed, wherein;

the electrical length of the spur line being varied by means of the compensating element such that the change in the magnitude of the power which is tapped off or supplied also makes it possible to compensate for the resistance change caused by the change in the way in which the power is split or joined together.

2. The circuit as claimed in claim 1, wherein the compensating element can be moved by means of a linearly movable control element.

3. The circuit as claimed in claim 2, wherein the control element has a slotted and/or guide groove which interacts with a guide device, which interacts with it, or with a guide pin, such that a linear adjustment movement of the control element is converted to a linear adjustment movement of the compensating element.

4. The circuit as claimed in claim 3, wherein the guide device comprises a guide pin on a transmission element, which is connected to the compensating element and moves together with it.

5. The circuit as claimed in claim 3, wherein the transmission element comprising a connecting stub, and is guided, and moved axially, in a guide device which is in the form of a sleeve.

6. The circuit as claimed in claim 1, wherein the adjustment movement of the control element is not proportional to the axial adjustment movement of the compensating element.

7. The circuit as claimed in claim 6, wherein the slotted guide or the guide groove is linear.

8. The circuit as claimed in claim 7, wherein the slotted guide or the guide groove is curved.

9. The circuit as claimed in claim 1, wherein, in order to compensate for the resistance change as a function of the power which is tapped off, the compensating element can be adjusted or preselected differently and/or can be fitted or removed, and which is a part of at least one capacitor which is connected to a branch line, or is coupled to such a part.

10. The circuit as claimed in claim 9, wherein the compensating element is designed such that, when the proportion of the power which is tapped off is changed, the electrical length of the spur line which is coupled to the branch line is changed at the same time in order to compensate for the associated resistance change.

11. The circuit as claimed in 1, that wherein the capacitances of the at least two variable capacitors can be varied by varying a common control element or compensating element.

12. The circuit as claimed in claim 1, wherein at least two series-connected capacitors are provided in the branch line, whose capacitances can be varied by varying the axial position of the compensating elements.

13. The circuit as claimed in claim 1, wherein the inner conductor of the main line has a section which is provided with a transverse hole, axially offset with respect to which, and DC-isolated from it, a further body is provided which is in the form of a sleeve and is part of the inner conductor of the branch line, the compensating element passing through the two bodies in the form of sleeves varied by varying the capacitance of the capacitors.

14. The circuit as claimed in claim 1, wherein the compensating element is electrically conductive.

15. The circuit as claimed in claim 1, wherein the compensating element is electrically non-conductive.

16. The circuit as claimed in claim 1, wherein the compensating element is isolated from the bodies in the form of sleeves, producing a separating gap, and/or is DC-isolated by using an insulator which is provided on the compensating element and/or on the inside of the bodies which are in the form of sleeves, and is composed of plastic.

17. The circuit as claimed claim 1, wherein the end axial separation between the two bodies which are in the form of sleeves is constant, can be preselected or can be varied.

18. The circuit as claimed in claim 1, wherein the compensating element is connected to a spindle drive, via which it can be moved axially.

19. The circuit as claimed in claim 1, wherein the step-up ratio between the control element and the adjustment movement of the compensating element is designed such that they are proportional to one another.

20. The circuit as claimed in claim 1, wherein the control element is designed with a scale or an adjustment and reading device, which is provided with an adjustment or reading device formed directly or indirectly on the housing, or with a scale, which is formed there, for reading the power split at the two output ports.

21. A circuit for splitting or joining radio-frequency powers, comprising:

a main path which is connected between an input port and a first output port, said main path having an associated inner conductor, a branch line which branches off from the main path at a branching point and leads to a second output port, said second output port having an associated inner conductor which leads to the second output port of the branch line, a spur line which is coupled to the branch line, and a compensating element for splitting or joining radio-frequency powers, the spur line being connected via a first capacitor to the inner conductor associated with the main path, and via a second capacitor to the inner conductor, associated with the second output port of the branch line.

the capacitances of the first and second capacitors being variable, the capacitances of the first and second capacitors being varied by means of the compensating element, which is adjustable or can be preselected differently, and/or can be installed or removed, wherein:

the electrical length of the spur line can be varied by means of the compensating element such that the change in the magnitude of the power which is tapped off or supplied also makes it possible to compensate for the resistance change caused by the change in the way in which the power is split or joined together, wherein the compensating element is connected to an adjusting body, which is provided in an axial extension of the branch line, on the opposite side from the main line.

22. A circuit for splitting or joining radio-frequency powers, comprising:

a main path which is connected between an input port and a first output port, said main path having an associated inner conductor, a branch line which branches off from the main path at a branching point and leads to a second output port, said second output port having an associated inner conductor which leads to the second output port of the branch line, a spur line which is coupled to the branch line, and a compensating element for splitting or joining radio-frequency powers, the spur line being connected via a first capacitor to the inner conductor associated with the main path, and via a second capacitor to the inner conductor, associated with the second output port of the branch line, the capacitances of the first and second capacitors being variable, the capacitances of the first and second capacitors being varied by means of the compensating element, which is adjustable or can be preselected differently, and/or can be installed or removed, wherein the spindle drive is arranged on the housing of the coaxial main line, on the opposite side to the branch line.

23. A circuit for splitting or joining radio-frequency powers, comprising:

a main path which is connected between an input port and a first output port, said main path having an associated inner conductor, a branch line which branches off from the main path at a branching point and leads to a second output port, said second output port having an associated inner conductor which leads to the second output port of the branch line, a spur line which is coupled to the branch line, and a compensating element for splitting or joining radio-frequency powers, the spur line being connected via a first capacitor to the inner conductor associated with the main path, and via a second capacitor to the inner conductor associated with the second output port of the branch line, the capacitances of the first and second capacitors being variable, the capacitances of the first and second capacitors being varied by means of the compensating element, which is adjustable or can be preselected differently, and/or can be installed or removed, wherein the compensating element can be moved by means of a linearly movable control element, and wherein the compensating element can be moved transversely, that is to say with an adjustment direction which runs at right angles to the movement direction of the control element.

24. A wideband RF power splitter having an input port and at least first and second output ports, said wideband RF power splitter comprising:

a power dividing network coupled between said input port and said first and second output ports, said power dividing network including at least first and second variable capacitors and a non-resonant connecting stub, said power dividing network splitting the RF power applied to the input port between said first and second output ports over a wide frequency range; and an adjustable compensating element mechanically coupled in common to each of said at least first and second variable capacitors and to said connecting stub, said adjustable compensating element changing the capacitances of said first and second variable capacitors and also changing the non-resonant electrical length of said connecting stub so as to change the split of said RF power output between said first and second output ports while simultaneously compensating for resistance changes caused by said changing split to thereby maintain the impedance presented at said input port substantially constant.

25. The power splitter of claim 24 wherein said bandwidth is at least 45%.

26. A wideband RF power joiner having first and second input ports and an output port, said wideband RF power joiner comprising:

a power joining network coupled between said first and second input ports and said output ports, said power joining network including at least first and second variable capacitors and a non-resonant connecting stub, said power joining network joining the RF power applied to the first and second input ports over a wide frequency range to said first and second output ports at a variable ratio; and an adjustable compensating element mechanically coupled in common to each of said at least first and second variable capacitors and to said non-resonant connecting stub, adjustment of said adjustable compensating element changing the capacitances of said first and second variable capacitors and also changing the non-resonant electrical length of said connecting stub so as to change the ratio of RF powers applied to said output port from said first and second input ports while simultaneously compensating for resistance changes caused by said changing ratio to thereby keep the impedance presented at said first and second input ports substantially the same.

27. The RF power joiner of claim 26 wherein said bandwidth is at least 45%.

* * * * *